United States Patent [19]

Forsyth et al.

[11] Patent Number: 5,007,482

[45] Date of Patent: Apr. 16, 1991

[54] OFFSHORE OIL PRODUCTION SYSTEM

[75] Inventors: Donald G. W. Forsyth; Robert W. Marshall; Alan M. Thompson, all of Glaslow, Scotland

[73] Assignee: British Petroleum Co. p.l.c., London, England

[21] Appl. No.: 490,879

[22] Filed: Mar. 9, 1990

[30] Foreign Application Priority Data

Mar. 9, 1989 [GB] United Kingdom ..... 8905364

[51] Int. Cl.[5] ..... E21B 43/01

[52] U.S. Cl. ..... 166/345; 166/350; 166/351; 166/363; 405/158; 405/172

[58] Field of Search ..... 166/343, 344, 350, 351, 166/356, 345, 347, 363; 405/169-171, 195, 202, 224, 158, 172; 441/2-5; 114/230

[56] References Cited

U.S. PATENT DOCUMENTS

| | | | |
|---|---|---|---|
| 4,182,584 | 1/1980 | Panicker et al. | 405/195 |
| 4,423,984 | 1/1984 | Panicker et al. | 405/195 |
| 4,462,717 | 7/1984 | Falcimaigne | 405/195 |
| 4,470,722 | 9/1984 | Gregory | 405/195 |
| 4,478,586 | 10/1984 | Gentry et al. | 441/4 |
| 4,529,334 | 7/1985 | Ortloff | 405/195 |
| 4,604,961 | 8/1986 | Ortloff et al. | 114/230 |
| 4,637,335 | 1/1987 | Pollack | 114/230 |
| 4,650,431 | 3/1987 | Kentosh | 441/5 |

*Primary Examiner*—Stephen J. Novosad

*Attorney, Agent, or Firm*—David J. Untener; Larry W. Evans

[57] ABSTRACT

An offshore oil production and mooring system comprises a subsea well head production system connected to a subsea base located on the sea bed. A subsea restraining buoy is located at a position below the sea surface but above the sea bed. The buoy is pivottally connected by a flexible lower support line to the subsea base and by a flexible upper support line to a buoyant riser endpiece adapted for connection to a loading vessel. The endpiece is located in its rest position at a position below the sea surface but above the sea bed and is anchorable to the sea bed. A flexible production riser rises from a subsea connector to the production system to the subsea restraining buoy and is supported by the lower support line. The riser then passes over the buoy and so to the riser endpiece, this section of the riser being supported by the upper support line. When moored to the system, a vessel is free to rotate around the mooring system using the torsional flexibility of the lower support line, the riser, and an umbilical and water injection line, if present. There are no swivels in the system, thus reducing complexity and costs.

17 Claims, 5 Drawing Sheets

OFFSHORE OIL PRODUCTION SYSTEM

This invention relates to an offshore oil production and mooring system, particularly a system for developing small fields.

In recent years a number of offshore oilfields have been discovered which are too small to be economically developed using expensive fixed production platforms supporting a number of producing wells. However, these fields contain significant amounts of recoverable oil and there is therefore a need for a production system which is more flexible and less expensive than fixed production systems.

UK Patent Application No. 2,066,758B discloses and claims an oil production system suitable for use at an offshore location comprising a floating storage vessel to receive the produced oil and having means for dynamic positioning, a single detachable riser supported from the vessel and detachably connectable to a subsea well head or to the vessel, the vessel further having means for separating the oil and its associated gas and employing the latter as fuel to power the dynamic positioning means.

The system is designed to produce oil from a single subsea well head.

We have now devised a flexible riser and mooring system (FRAMS) system which is suitable for use with a subsea production system having a number of well heads and which, in addition, has the capacity for water and/or chemicals injection, if required.

Thus according to the present invention there is provided an offshore oil production and mooring system comprising:

(a) a subsea base located on the sea bed associated with (b) a subsea connector adapted for connecting a subsea well head production system to a production riser, (c) a subsea restraining buoy located at a position below the sea surface but above the sea bed, (d) a buoyant riser endpiece adapted for connection to a loading vessel, located in its rest position at a position below the sea surface but above the sea bed, and anchorable to the sea bed, (e) a flexible lower support line pivotally connecting the restraining buoy to the subsea base, (f) a flexible upper support line pivotally connecting the restraining buoy to the riser endpiece, and (g) a flexible production riser connected to the subsea connector (b) and supported by the lower support line (e), and subsea restaining buoy (c), and the upper support line (f) and connected to the riser endpiece (d).

Associated with the riser will usually be (h) an umbilical line, for supplying electrical and/or hydraulic power to the subsea well head production system, connected to the subsea connector (b) and supported by the lower support line (e), the subsea restraining buoy (c), and the upper support line (f) and connected to the riser endpiece (d).

A water injection (i) line may also be connected to the subsea connector (b) and supported by the lower support line (e), the subsea restraining buoy (c) and the upper support line (f) and connected to the riser endpiece (d).

The riser endpiece preferably comprises a male connector and a buoyancy module.

The buoyancy module preferably comprises an asymmetrically fitted portion to prevent misalignment on connection.

In addition, the riser endpiece is preferably fitted with a cover to protect the connector and guide the riser endpiece when a connection is being made.

The cover is suitably in the shape of a sledge.

When the system is "parked", i.e., when it is not connected to the loading vessel, the riser endpiece is anchored with the position of the anchor indicated at the sea surface by a pennant buoy. Restraining the riser endpiece prevents the riser and lines from drifting back and twisting.

To bring the system into use, i.e., to connect it to the loading vessel, the riser endpiece is lifted and the connector of the riser endpiece connected to a corresponding connector on board the vessel.

The vessel is adapted to receive, store, transport and preferably degas produced crude oil.

It is suitably a modified tanker with its bows cleft to permit the entry of the riser endpiece.

A suitable size of the tanker is in the range 40,000–70,000 dwt.

When moored to the flexible riser and mooring system, the vessel is free to rotate around the mooring system using the torsional flexibility of the lower support line, the riser, the umbilical and the water injection line, if present. There are no swivels in the system, thus reducing complexity and costs.

Cables of wire rope are very suitable materials for the lower and upper support lines.

The lower support line is preferably connected to the subsea base by means of a universal joint.

To enhance flexibility, the production riser, the umbilical and the water injection line are preferably not amalgamated into a bundle but are positioned along the supported lines by spiders.

The lower riser, i.e. that part of the riser below the restraining buoy, is designed to accept all the torsion input by rotation of the vessel as it moves around the mooring, up to the design torsion limit.

To allow the lower riser flexibles to accept this torsion the lower riser may be designed with the flexibles having an excess length over the lower support line of say 5 to 15%, preferably about 10%.

This arrangement allows out of plane bending to occur as well as twisting and prevents and end fitting having to restrain excessive torque.

To ensure even distribution of the excess length along the length of the lower support line in a controlled manner, the spiders should be positioned at regular intervals, e.g. 5 m.

The lower riser spiders are preferably held in position by separation cables, preferably two in number, suspended from the restraining buoy.

The torsional limit of flexible pipe is normally limited to $\pm 1$ degree per meter. With the above arrangement it is possible for the rotation limit to be increased to $\pm 3$ degrees per meter.

The upper riser spiders are similar to those used on the lower riser. Separation cables are not required, however, because the rotational movement is transferred to the lower riser.

The subsea restraining buoy may be spherical or cylindrical in configuration, but preferably the latter. It behaves as an inverted pendulum and therefore the greater the horizontal displacement, the greater is the restoring force.

A convenient size for the restraining buoy is 200 displacement tonnes.

Suitable materials of construction for the restraining buoy include steel and GRP.

The lower support line should be as long as possible. A long length will reduce the increase in restoring force due to the change of vessel offset during passing of a wave. Vessels moored on a longer length of mooring have higher operational limits than with shorter lengths. The longer length reduces the possibility of snatch loads and increases fatique life of the mooring.

The upper support line should be at least as long as the lower support line to allow for limited movement of the vessel (e.g. ±5% water depth) without the exertion of undue forces.

Subject to the above, the restraining buoy is preferably moored at a depth in the range ½ to ⅓ water depth below the sea surface, e.g. 50 m, to ensure clearance by other vessels.

The mooring buoy may be of a conventional type.

The vessel is preferably provided with processing facilities to degas the crude oil before storage and subsequent transportation. Gas is separated from the well stream fluids and excess gas flared. The tanker loadable crude is pumped into the tanker cargo holds. When the tanks are full, the tanker disconnects the mooring, shuts down the reservoir and sails to an unloading terminal.

In bad wheather when the significant wave-height exceeds 4.5 m (approximately force ⅞ gale), or the torsional capability of the wire is taken up, the vessel disconnects the mooring.

The topsides equipment should be selected and sized in accordance with the following main principles:

Minimum oil processing, consistent with stabilisation and high recovery of crude oil.

Power generation installed sufficient to meet power requirements when on station, to take advantage of available gas, rather than use vessel's power.

Flaring of produced gas surplus to fuel requirement.

Injection water required for reservoir pressure maintenance filtered and de-oxygenated to a reasonable degree only, taking account of anticipated high permeability and short field life.

Maximum use made of existing tanker facilities: accommodation, fresh water supply, power generation and sea water pumping.

Produced water treatment on the tanker.

The subsea elements of the development may comprise, for example:

Two producer and two water injection wells in a tight cluster around a manifold structure to which they are connected by flexible jumper hoses.

The manifold structure comprising a space frame supporting a production header, an injection water header, a service header, control pod and distribution pipework for chemical injection and control fluids.

Two parallel flowlines to the mooring base, one for production fluids and one for injection water.

Valve Control System: Power supply and control room are on board the vessel, composite electro-hydraulic umbilical from the vessel to the manifold subsea control pod and jumper hoses and power cables to individual wells. Electrical signals are transmitted back from pressure and temperature instrumentation on the wells and manifolds.

Chemical injection by hoses in the electro hydraulic umbilical and distributed from the manifold as the hydraulic power fluid.

Annulus monitoring and bleed-down via jumper hose, service header and dedicated hose in the umbilical.

It is believed that the use of such a system can offer significant advantages for the development of small reservoirs on capital and operating costs and can reduce the timespace between project start and first oil.

Suitable reservoirs would have a peak throughput of about 8–10,0000 bpd and a field life of about five years.

The invention is illustrated with reference to FIGS. 1–9 of the accompanying drawings, wherein.

Figure 1:
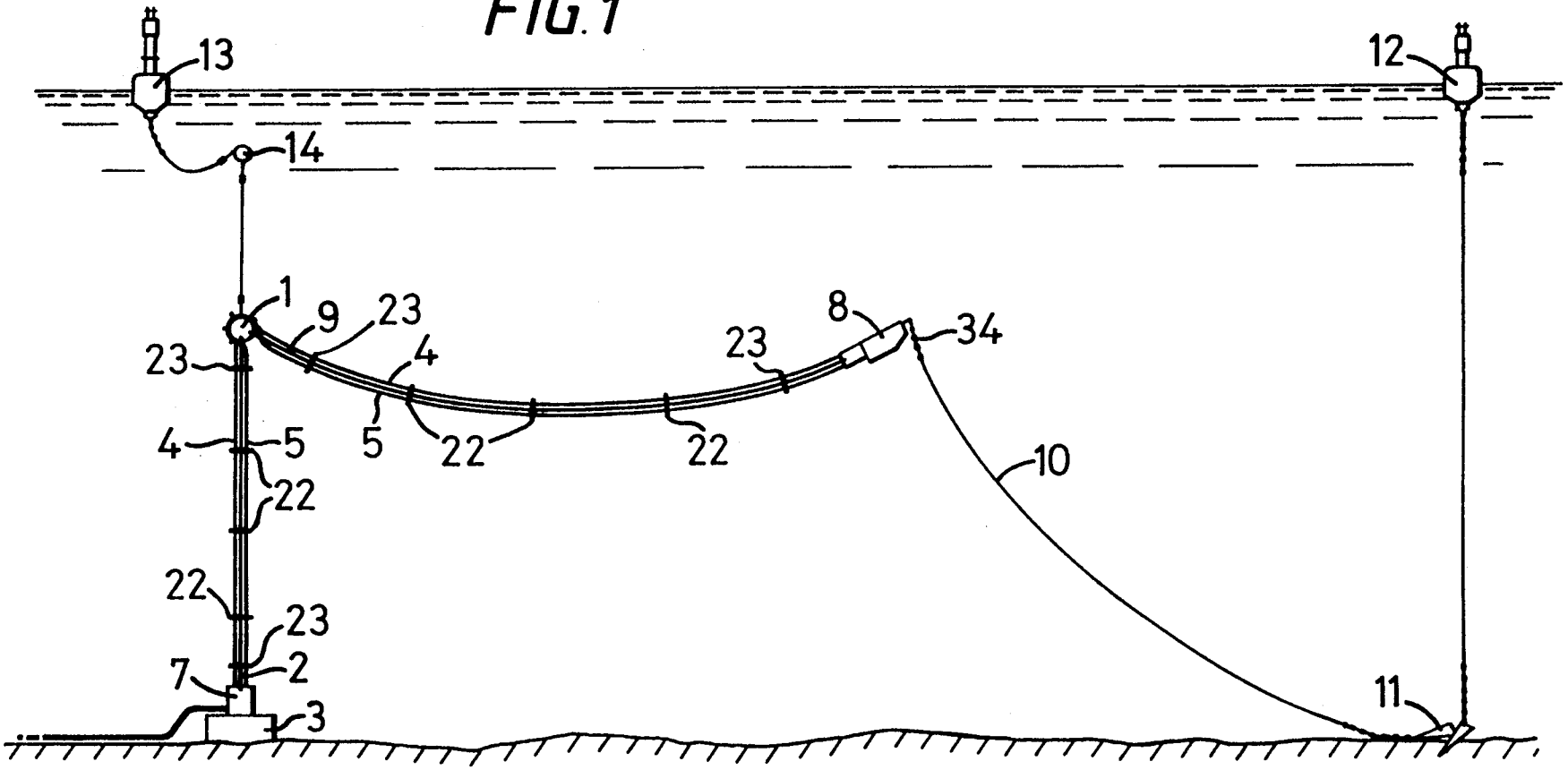
FIG. 1 is a schematic diagram of the general arrangement of the system, with no vessel present.

With reference of FIG. 1, the flexible riser and mooring system (FRAMS) comprises a subsea restraining buoy (1) moored by means of a flexible lower support line (2) to a subsea base (3) located on the sea bed. Associated with the lower support line (2) is a flexible production riser (4), a water injection line (5) and an umbilical (6) hidden by the other lines in FIGS. 1 and 2, but visible in FIGS. 4, 5 and 7. The production riser (4), water injection line (5) and umbilical (6) terminate in connectors in a subsea connector (7) which in turn is connected to a subsea production system (not shown).

The subsea restraining buoy (1) is also connected to a buoyant riser endpiece (8) by means of a flexible upper support line (9). The flexible production riser (4), water injection line (5) and umbilical (6) pass over the restraining buoy (1) and continue in association with the upper support line and also terminate in the riser endpiece (8).

The riser endpiece (8) is anchored subsea by means of a mooring chafe chain (34) attached to a polyester braidline pick-up line (10) attached to an anchor (11). The position of the anchor (11) is marked by a mooring pick-up buoy (12).

The position of the restraining buoy (1), and hence of the producing field is marked by a field marked buoy (13) tethered to a small subsea buoy (14) tethered to the restraining buoy (1).

Figure 2:
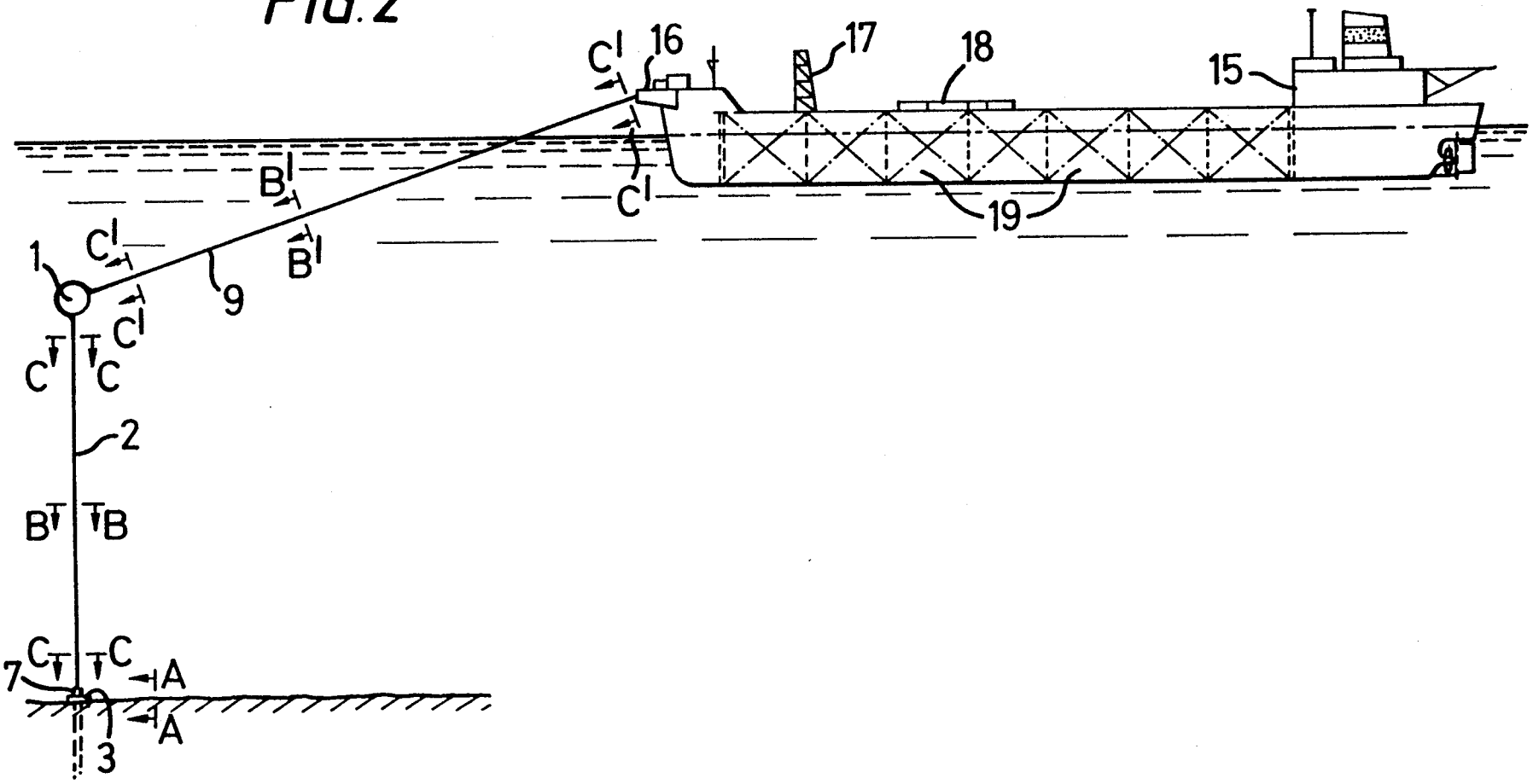
FIG. 2 is a schematic diagram showing the system connected to a converted tanker.

In FIG. 2 the system is shown connected to a converted tanker (15) of 60,000 DWT.

The subsea restraining buoy (1) is moored 100 m above the sea bed in a total water depth of 150 m, i.e., the lower support line (2) is 100 m long. The upper short line (9) mooring the tanker (15) to the buoy (1) is 150 m long. The tanker (15) is fitted with a cleft bow (16) shown more clearly in FIG. 9, a flare stack (17), process equipment (18) and storage tanks (19).

Figure 3:
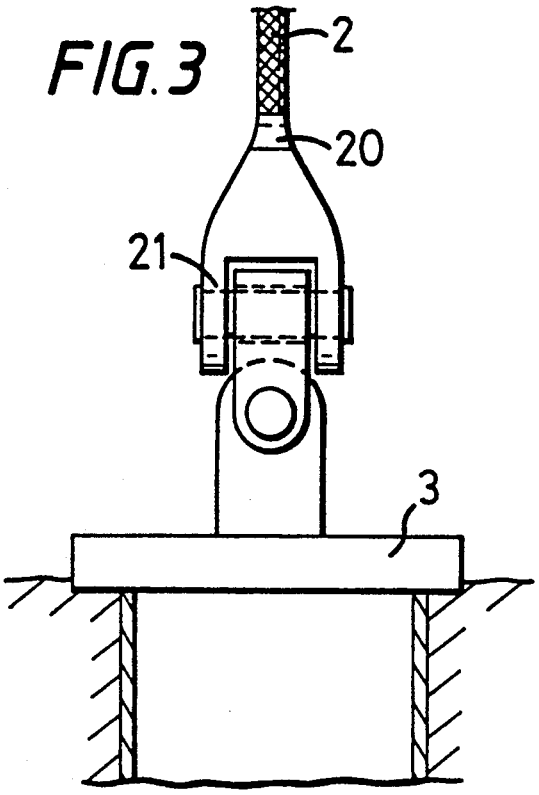
FIGS. 3, 4 and 5 are sections on AA, BB and CC respectively of FIG. 2.

FIG. 3 is a section on AA of FIG. 2 showing a detail of the connection of the lower support line (2) to the subsea base (3).

The support line (2) is a 5-inch spiral wire rope connected to an open socket connector (20) on turn connected by a universal joint (21) to the subsea base (3). The universal joint (21) has water lubricated bearings.

Figure 4:
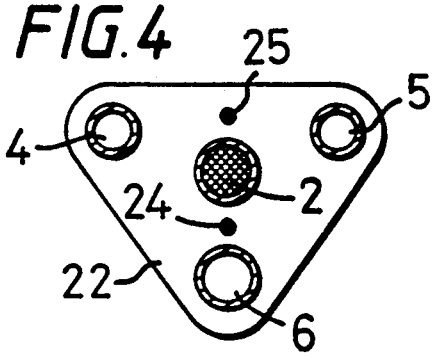

FIG. 4 is a section on BB of FIG. 2. i.e. at the mid point of the lower support line. The support line (9) is also a 5-inch spiral strand wire rope. The production riser (4) and the water injection line (5) and 4 inch O/D flexible tubes and the umbilical (6) is a 5 inch O/D line. The lines are linked together by means of spiders (22)

repeated at regular intervals along the lines as indicated in FIG. 1. The configuration shown in FIG. 4 maximises strength and resistance to twisting by positioning the support line at the center of an equilateral triangle.

Figure 5:
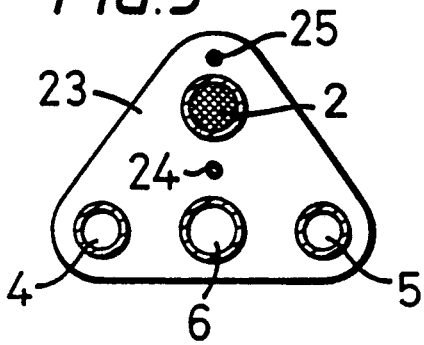

FIG. 5 is a section on CC of FIG. 2 and shows the configuration adopted when the group of lines approaches a surface to which the support lines are connected and in this case, the spiders (23) are of different shape and the support line is at the apex of an isosceles triangle with the other lines and umbilical forming the base. This configuration facilitates junctions and connections, as indicated in FIG. 1.

The spiders (22) and (23) are supported on separation cables (24) and (25) in a manner similar to the rungs of a rope ladder, the cables (24) and (25) being suspended from the restraining buoy (1).

Similar spiders are used in supported the flexible lines on the upper support line 9 at C'C' and regular intervals B'B' but in this case the separation cables (24) and (25) are not necessary.

Figure 6:
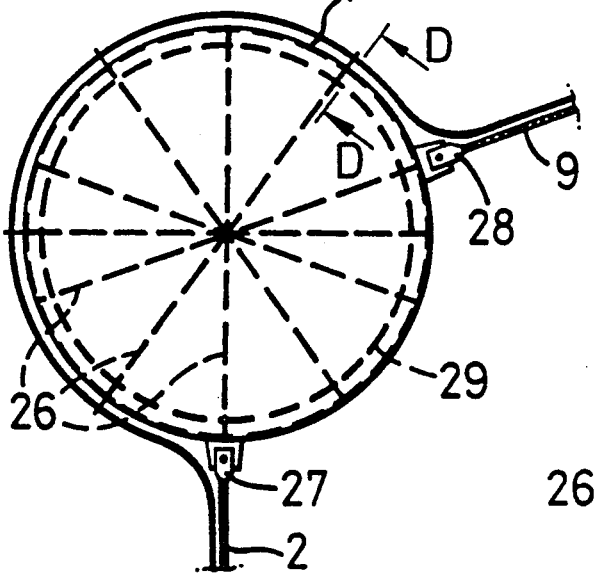
FIG. 6 is an elevation of a subsea restraining buoy.
Figure 7:
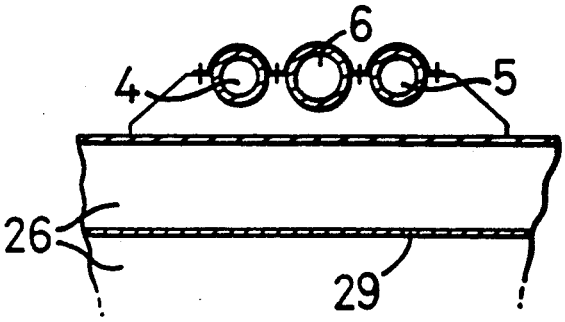
FIG. 7 is a section on DD of FIG. 6.

FIGS. 6 and 7 relate to the restraining buoy (1). The buoy is a spherical 8 m diameter steel structure of 200 tonnes. It is divided into compartments by stiffened plate bulkheads (26). These bulkheads are aligned to carry the loads from the lower and upper support lines (2) and (9). The lines are attached to the buoy by open fork pinned sockets (27) and (28). The buoy is also strengthened by ring stiffeners (29).

FIG. 7 is a section of DD of FIG. 6 showing how the production riser (4), water injection line (5) and umbilical (6) are carried over the surface of the buoy (1). An internal bulkhead (26) and an internal ring stiffener (29) are also illustrated.

Figure 8:
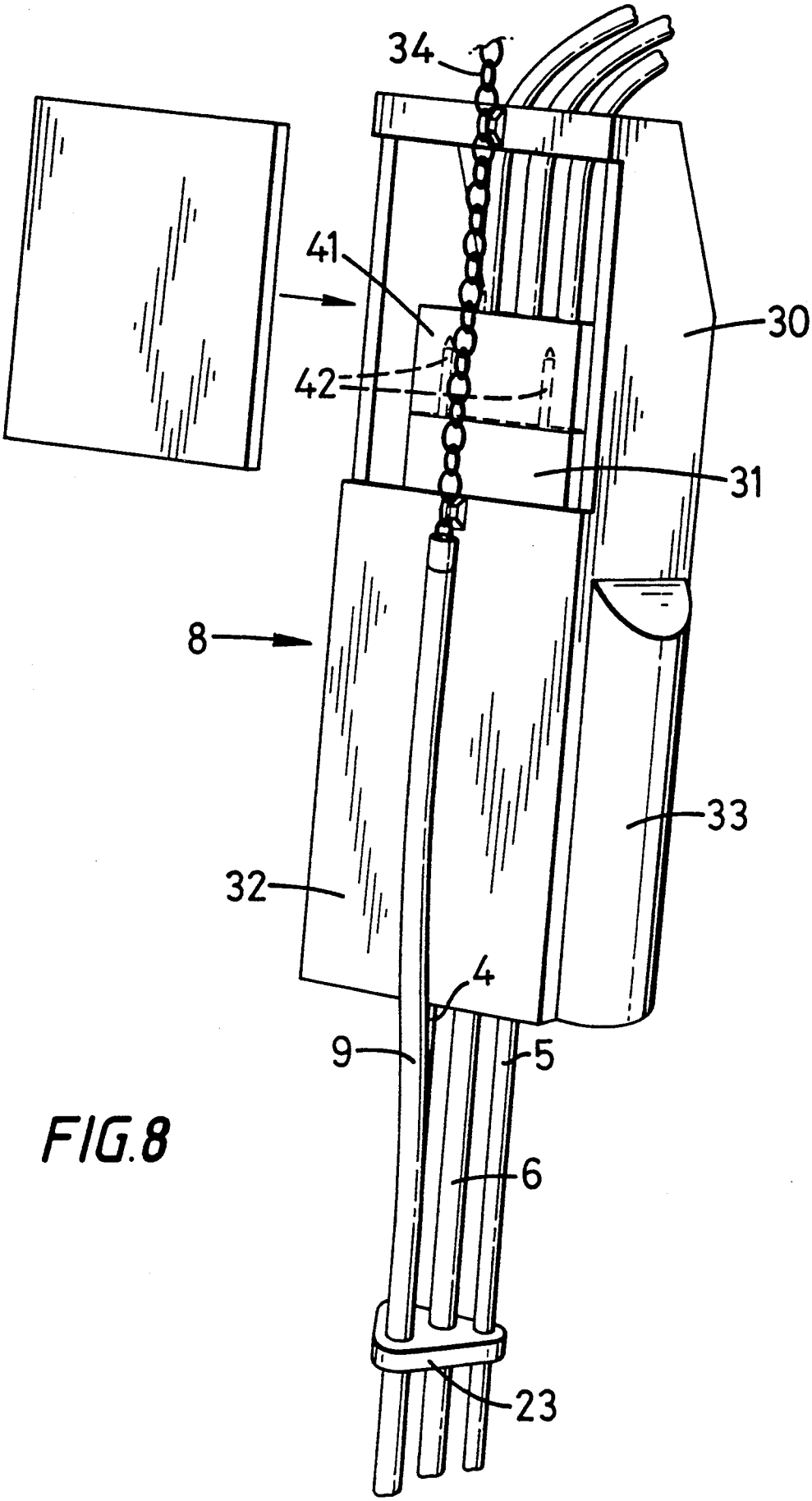
FIG. 8 is an isometric view of a riser endpiece.

With reference to FIG. 8, the riser endpiece (8) comprises three major elements, viz a cover in the form of a guide sledge (30), the male half (31) of a coupling having guild pins (42) and a buoyancy module (32). The female half (41) of the coupling forms part of the entry system in the cleft bow (16) of the tanker (15).

The guide sledge (30) is an open fabricated steel structure, sledge shaped to allow a smooth pull in at the bow of the tanker whilst offering protection to the male half of the coupling and also to the female half when engaged. The sledge has built in alignment guides to assist the coupling to engage.

To avoid the risk of the connection being made up 360° out, 10% eccentricity is added to the buoyancy module (32) which is basically cuboid with a hole down its longitudinal center line to allow the passage of flexibles, i.e. the production riser (4), the water injection line (5) and the umbilical (6) from the coupling. The eccentricity is added in the form of a blister (33) attached to one side of the buoyancy module (32) to ensure that the riser endpiece always rotates clockwise on emergence from the sea and anti-clockwise on re-entry.

The upper support line (9) and a mooring chain (34) attached to the pick-up line (10) are also connected to the buoyancy module (32).

Figure 9:
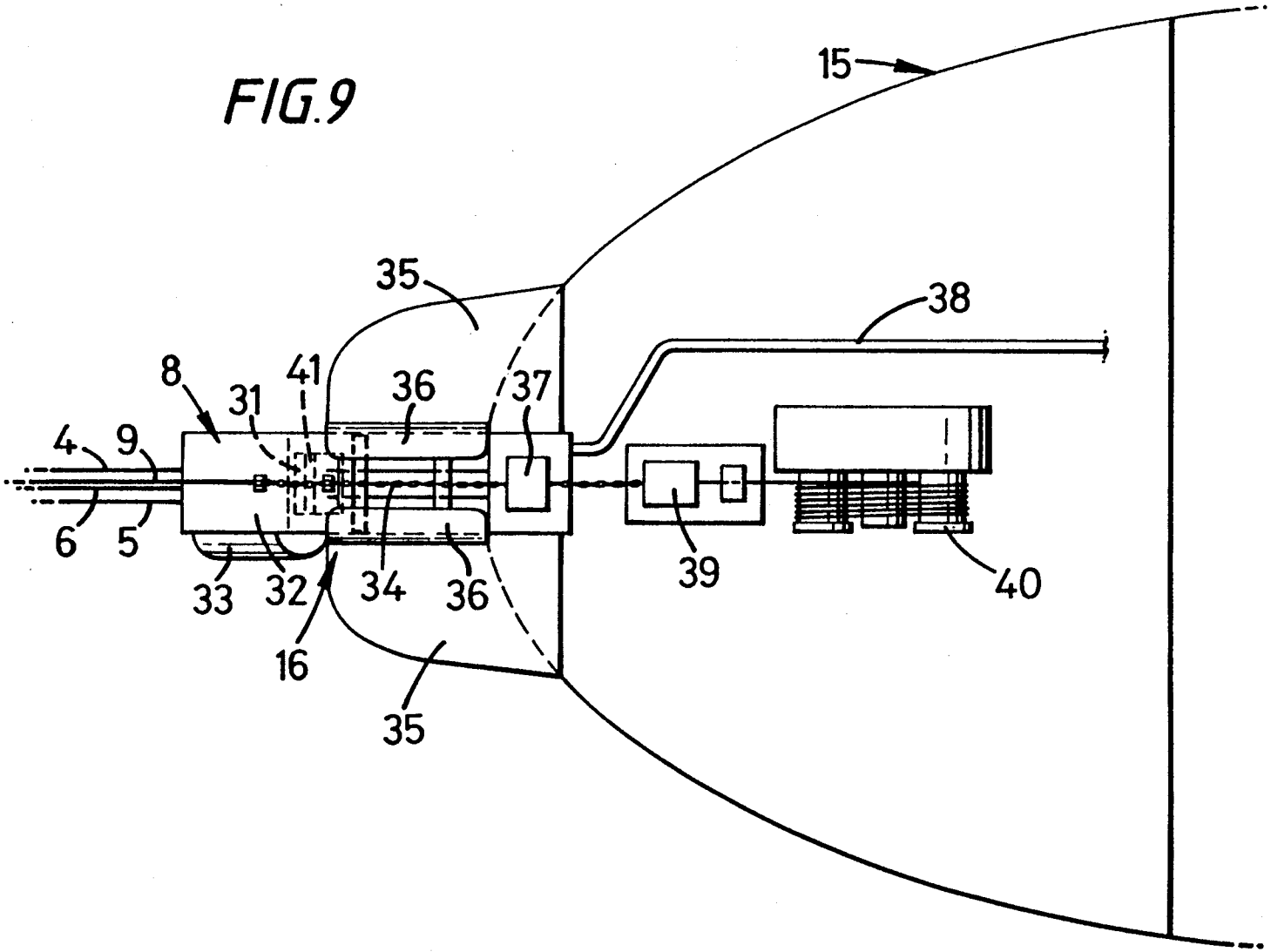
FIG. 9 is a plan view of the bow of a suitable vessel.

FIG. 9 is a plan view of the bow of the tanker showing the cleft 16 protected by flared extension sides (35). Vertical guide plates 36 are provided which co-operate with the guide sledge (30) of FIG. 8 to guide the riser endpiece (8) into the correct location for coupling its male half with the female half (41) associated with a termination box (37) on board the tanker.

Production fluid is taken from the termination box (37) to the processing equipment by means of a pipeline (38).

The coupling unit is a relatively standard MIB latching unit conveying the contents of well fluid, well injection water and electric and hydraulic lines.

The anchor chain (34) and pick up line (10) are pulled through a chain stopper unit (39) by means of a traction winch (40).

The stopper unit (39) comprises a fairlead and chain stopper assembly including a hydraulically activated cradle-mounted latch and a load cell. The traction winch (40) is a cantilevered type horizontal twin drum winch.

In order to make a connection, the riser endpiece is drawn out of the water by the cable being winched in on the traction winch. The endpiece is aligned by the guides. The hawser stopper unit clamps onto the chain. The female connector half is lowered onto the endpiece by a hoist and the connection made up.

A typical mooring sequence is outlined below:

(a) The FRAMS tanker and a FSV (Field Service Vessel) approach the field.

(b) The FSV proceeds to the mooring pick up buoy. The buoy is lassoed, decked, and the anchor lifted from the seabed and decked. The polyester braidline pick up line is disconnected, and connected to a polypropylene messenger, in preparation for the transfer by air gun to the FRAMS tanker.

(c) The FSV manoeuvres in the most suitable condition for the FRAMS tanker's approach. The FRAMS tanker then commences its final approach to location.

(d) On board the FSV a line throwing apparatus is ready, and the two vessels manoeuvre for the optimum position for firing the line. Once the line is across to the FRAMS tanker, the polypropylene messenger is streamed and the FSV stands by the assist the FRAMS tanker.

The FRAMS tanker hauls in the messenger rope and the pick-up rope, and feeds these to a storage drum, via the traction winch.

With the pick up line on the winch, the FRAMS tanker steadily hauls in the combined riser/mooring until the riser endpiece is on board and the chafe chain secured in the chain stopper.

The free end of a pellet buoy line is clipped onto a special lugged link in the chafe chain for emergency release opertions. Only then will a pin connecting the pick up rope and chafe chain be withdrawn, leaving the eye alongside the chain. Production can start upon connection of the connector unit.

A normal unmooring sequence is as follows:

(a) On completion of cargo operations, either for deteriorating weather or operational reasons, loading stops and the normal completion of production shutdown, flushing oil line, etc, is carried out, and the connector unit disconnected.

(b) The riser/mooring connection pin is reconnected. The pellet buoy line is disconnected and returned to its standby position. The pick up line is paid off the winch in a controlled manner. The FSV would at this stage approaches the bow of the FRAMS tanker.

(c) Once the mooring and pick up line is paid out, the polypropylene messenger is streamed, or passed to the FSV.

(d) The FRAMS tanker then departs the field location, and the FSV reinstates the anchor on to the pick up line, laying the anchor in the designated area, after connecting the buoy riser system and mooring pick-up buoy.

We claim:

1. A swivel-less offshore oil production and mooring system comprising:

(a) a subsea base located on the sea bed associated with (b) a subsea connector, adpated for connecting a subsea well head production system to a production riser, (c) a subsea restraining buoy located at a position below the sea surface but above the sea bed, (d) a buoyant riser endpiece adapted for a swivel-less connection to a loading vessel, located in its rest position at a position below the sea surface but above the sea bed, and anchorable to the sea bed, (e) a flexible lower support line pivotally connecting the restraining buoy to the subsea base, (f) a flexible upper support line pivotally connecting the restraining buoy to the riser endpiece, and (g) a flexible production riser connected to the subsea connector and supported by the lower support line, the subsea restraining buoy and the upper support line and connected to the riser endpiece.

2. An offshore oil production and mooring system according to claim 1 comprising in addition.

(h) an umbilical line, for supplying electrical and/or hydraulic power to the subsea well head production system, connected to the subsea connector and supported by the lower support line, the subsea restraining buoy and the upper support line and connected to the riser endpiece.

3. An offshore oil production and mooring system according to claim 1 comprising in addition.

(i) a water injection line connected to the subsea connector and supported by the lower support line, the subsea restraining buoy and the upper support line and connected to the riser endpiece.

4. An offshore oil production and mooring system according to claim 1 wherein the riser endpiece comprises a connector and a buoyancy module.

5. An offshore oil production and mooring system according to claim 4 wherein the connector is a male connector.

6. An offshore oil production and mooring system according to claim 4 wherein the buoyancy module comprises an asymmetrically fitted portion.

7. An offshore oil production and mooring system according to claim 4 wherein the riser endpiece is fitted with a cover to protect the connector and guide the riser endpiece when a connection is being made.

8. An offshore oil production and mooring system according to claim 7 wherein the cover is in the shape of a sledge.

9. An offshore oil production and mooring system according to claim 1 wherein the lower support line is connected to the base by means of a universal joint.

10. An offshore oil production and mooring system according to claim 1 wherein the production riser and associated lines are positioned aong the support lines by spiders.

11. An offshore oil production and mooring system according to claim 10 wherein that portion of the production riser associated with lower support line has an excess length over the lower support line of 5 to 15%.

12. An offshore oil production and mooring system according to claim 10 wherein those spiders associated with the lower support line are held in position by separation cables suspended from the restraining buoy.

13. An offshore oil production and mooring system according to claim 1 wherein the restraining buoy is cylindrical in configuration.

14. An offshore oil production and mooring system according to claim 1 wherein the upper support line is at least as long as the lower support line.

15. An offshore oil production and mooring system according to claim 1 wherein the restraining buoy is moored at a depth in the range ½ to ⅓ water depth below the sea surface.

16. An offshore oil production and mooring system according to claim 1 in combination with a loading vessel wherein the connector of the riser endpiece is connected to a corresponding connector on board the vessel.

17. An offshore oil production and mooring system according to claim 16 wherein the vessel is a modified tanker with its bow cleft to permit the entry of the riser endpiece.

* * * * *